US006745725B2

(12) United States Patent
Toniolo et al.

(10) Patent No.: US 6,745,725 B2
(45) Date of Patent: Jun. 8, 2004

(54) SAFETY WATER-HEATER VALVE ADJUSTMENT

(75) Inventors: Alessandro Toniolo, Torre (IT); Stefano Zanella, Montebelluna (IT)

(73) Assignee: Sit la Precisa S.p.A., Padua (IT)

( * ) Notice: Subject to any disclaimer, the term of this patent is extended or adjusted under 35 U.S.C. 154(b) by 0 days.

(21) Appl. No.: 10/271,195

(22) Filed: Oct. 15, 2002

(65) Prior Publication Data

US 2004/0050344 A1 Mar. 18, 2004

(30) Foreign Application Priority Data

Sep. 16, 2002 (IT) ..... PD2002A0236

(51) Int. Cl.[7] ..... F16K 35/02
(52) U.S. Cl. ..... 122/504; 122/507; 251/96
(58) Field of Search ..... 122/501, 504, 122/507; 251/92, 96, 89, 97, 215, 296

(56) References Cited

U.S. PATENT DOCUMENTS 4,635,680 A * 1/1987 Fang ..... 137/614.18
5,230,465 A * 7/1993 Kostorz et al. ..... 236/12.1
6,340,148 B1 * 1/2002 Sung ..... 251/96
6,347,784 B1 * 2/2002 Philipps-Liebich et al. ... 251/92
6,375,150 B1 * 4/2002 Aguirre-Esponda et al. .. 251/96
6,471,135 B2 * 10/2002 Paolucci ..... 236/102
6,571,829 B2 * 6/2003 Kuriyama et al. ..... 251/251

FOREIGN PATENT DOCUMENTS

WO WO 02/06712 1/2002

* cited by examiner

*Primary Examiner*—Gregory Wilson
(74) *Attorney, Agent, or Firm*—RatnerPrestia

(57) ABSTRACT

A knob adjustment device, particularly for adjusting the temperature in valve units of a water-heating apparatus. The knob adjustment device is mounted so as to be rotatable about a rotation axis in a stationary housing of the valve unit and has a safety member for the unidirectional restraint of the knob adjustment device relative to the housing so as to oppose rotation of the knob adjustment device in a first direction of rotation about the axis, the knob adjustment device being free to rotate in the opposite direction of rotation.

18 Claims, 4 Drawing Sheets

SAFETY WATER-HEATER VALVE ADJUSTMENT

DESCRIPTION

The present invention relates to a knob adjustment device, in particular for adjusting the temperature in water-heating apparatus, according to the preamble to the main claim.

The invention relates in particular to the field of water-heating apparatus such as, for example, domestic water heaters, in which there is a thermostatically-controlled valve unit provided with a knob adjustment device for adjusting the temperature of the water to be heated.

An example of an adjustment device of this type is described in the Applicant's patent application No. PD2000A000185.

The above-mentioned knob adjustment device is arranged to incorporate the operative control functions by means of which the user can permit lighting of the pilot-light and shutting-off of the gas-flow and, in addition, can select the desired water-temperature value. These functions can be selected by the user by rotation of the above-mentioned knob device.

Within this technical field, a need has arisen to ensure safety locking of the knob to prevent its accidental rotation during the operation of the water-heater, which could lead to undesired and, in some cases, dangerous increases in the water temperature. A typical condition to be prevented is that in which accidental operation of the knob, for example, by children, may lead to an increase in the water temperature such that it is dangerous in use.

A main object of the invention is to provide a knob adjustment device of the above-mentioned type which is designed structurally and functionally to satisfy the need indicated, ensuring safety locking of the knob when the water-heater is in operation, and which can prevent undesired accidental rotation.

Another object is to provide a knob adjustment device in which rapid operation of the knob from the safety locking position towards a switched-off position or, in any case, a position in which the water temperature is reduced, is permitted so as to ensure that the device is made safe quickly if conditions dangerous to the user should arise.

These and other objects which will be made clear below are achieved, according to the present invention, by a knob adjustment device, in particular for water-heating apparatus, having the characteristics set out in the appended claims.

Figure 1:
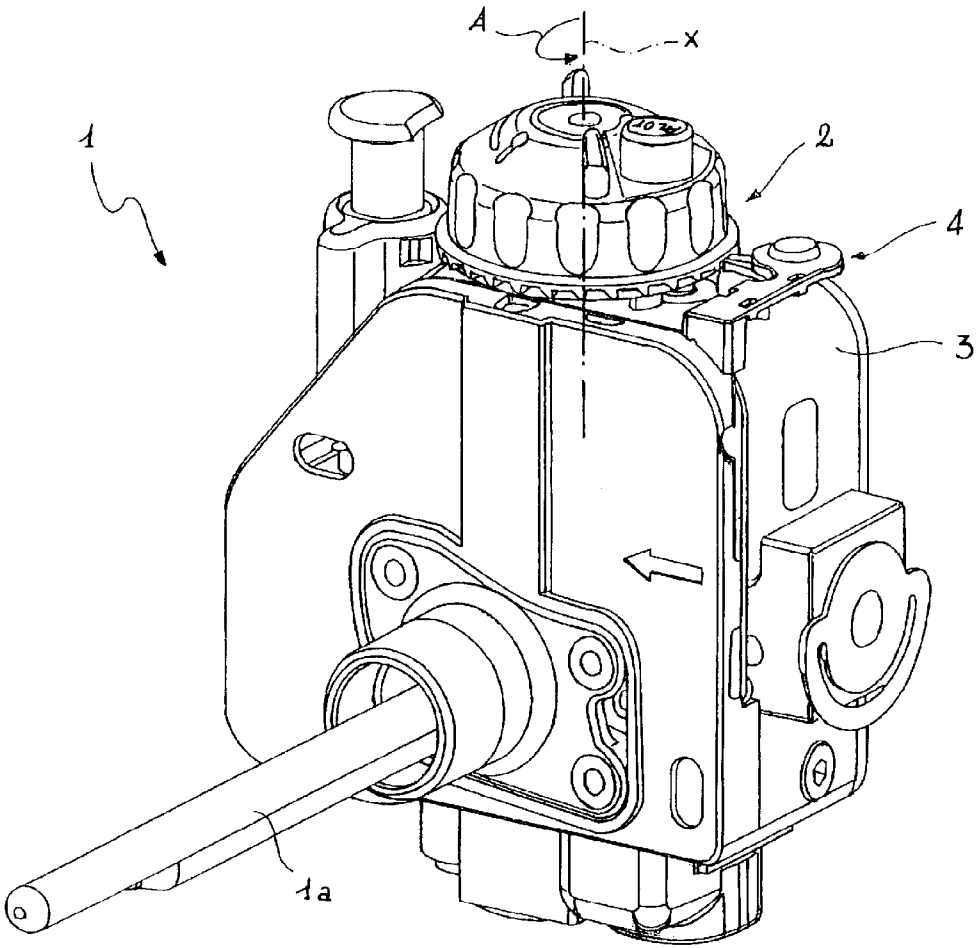
Figure 2:
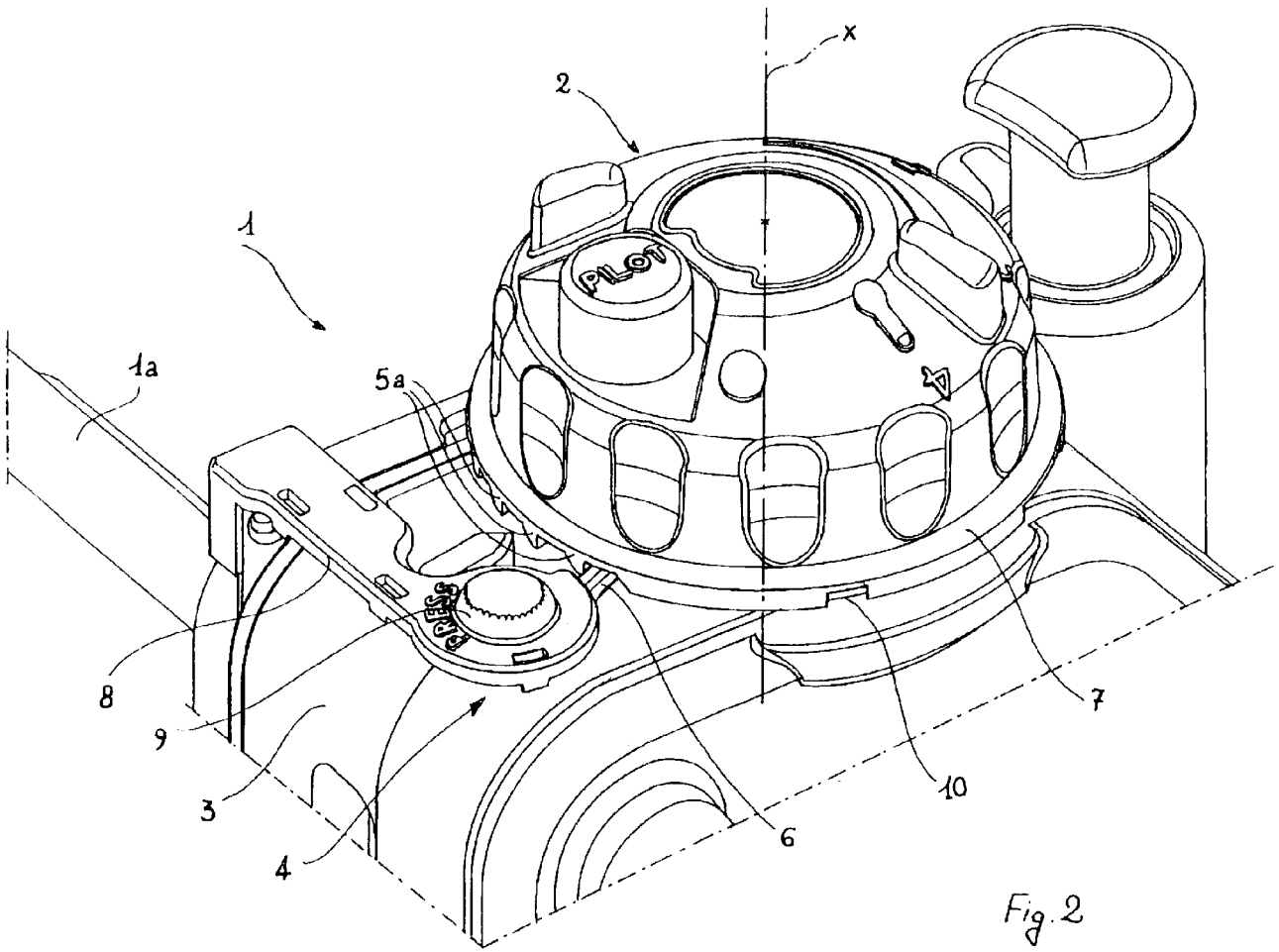
Figure 3:
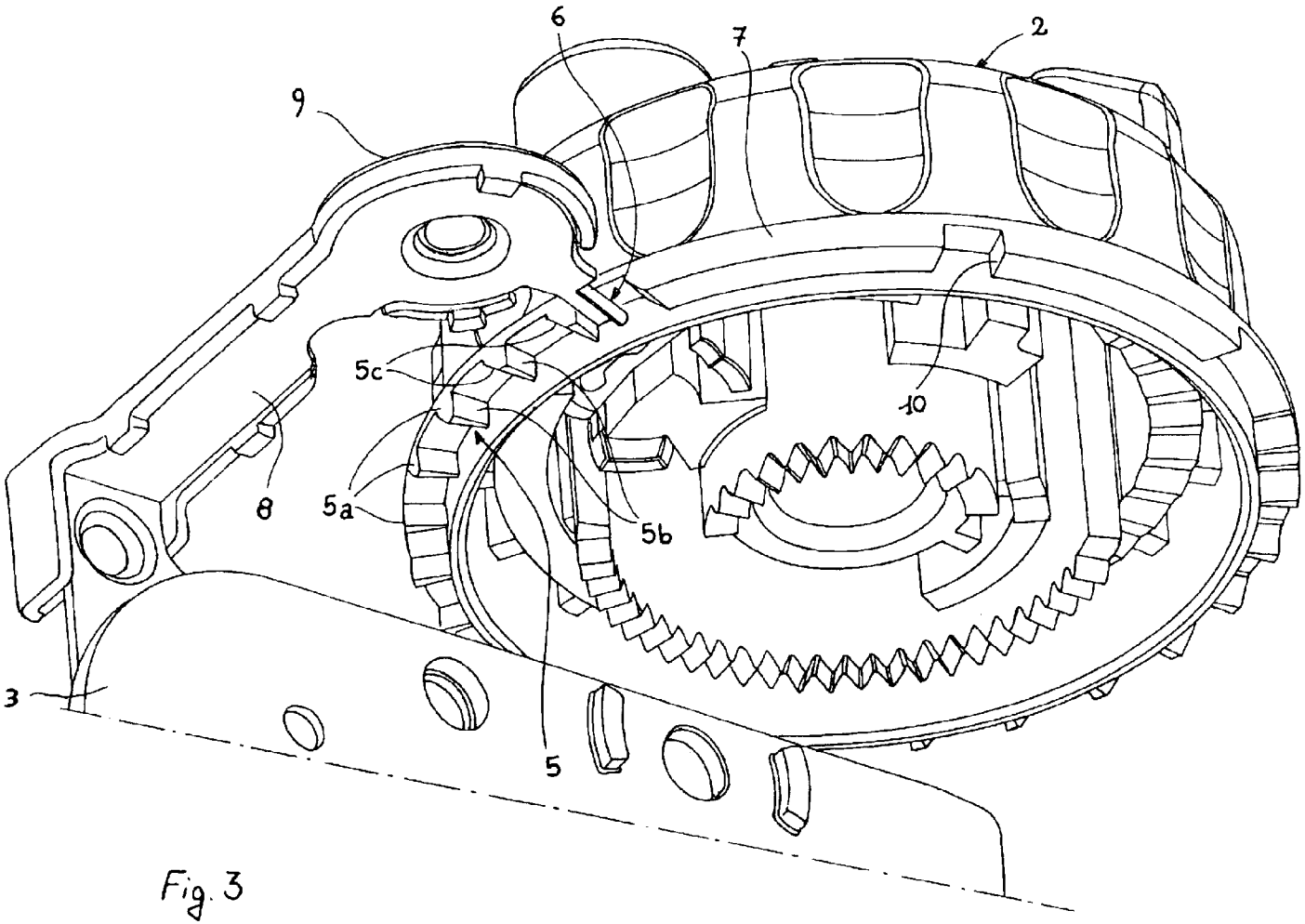
Figure 4:
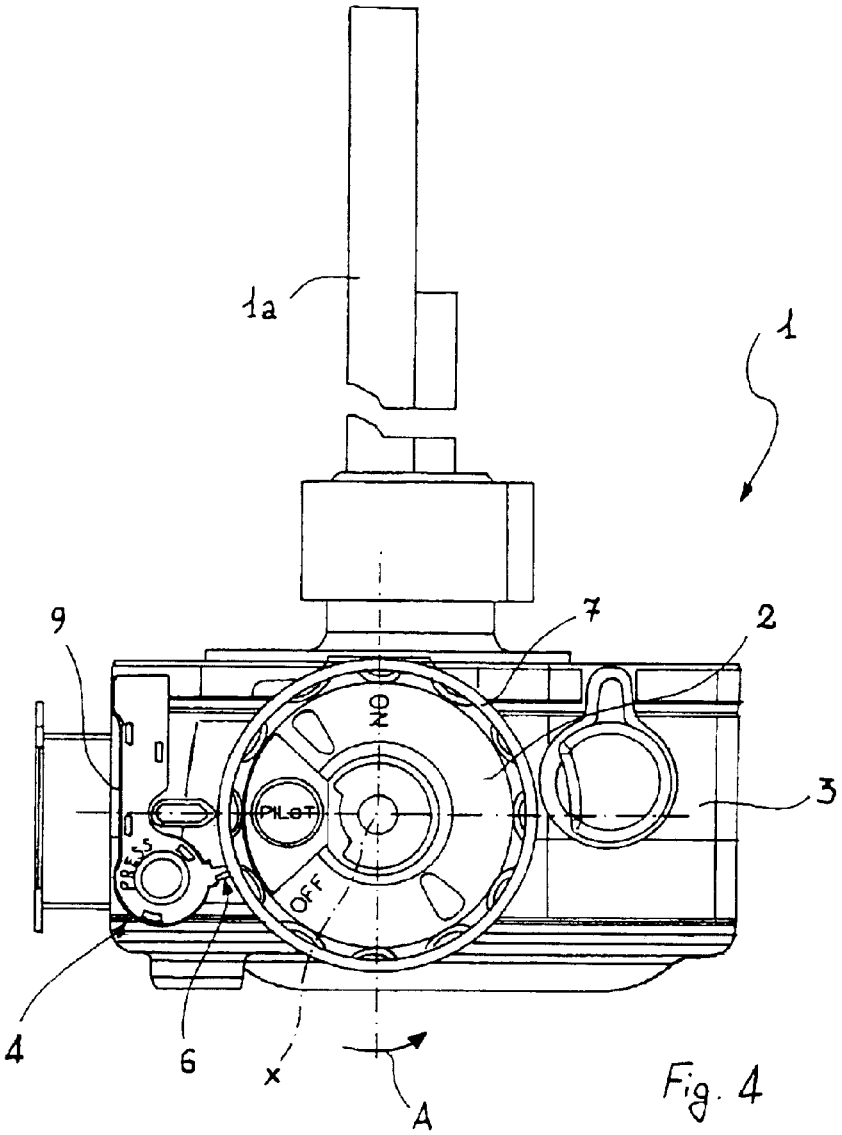
Figure 5:
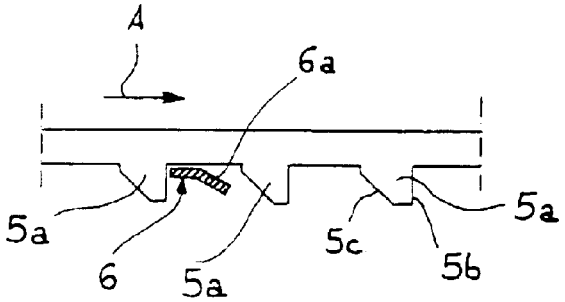

The characteristics and the advantages of the invention will become clearer from the following detailed description of a preferred embodiment thereof, given with reference to the appended drawings, provided by way of non-limiting example in which:

FIG. 1 is a schematic, perspective view of a valve unit equipped with a knob adjustment device formed in accordance with the present invention, FIGS. 2 and 3 are partial perspective views showing a detail of the device of the previous drawing on an enlarged scale, FIG. 4 is a plan view of the valve unit of the previous drawings from above, and FIG. 5 is a partial schematic view showing a detail of the previous drawings on is an enlarged scale.

With reference to the drawings mentioned, a valve unit equipped with a knob adjustment device 2 formed in accordance with the present invention is generally indicated 1. The valve unit described in this embodiment of the invention is of the thermostatically-controlled type and is intended mainly for the adjustment and control of the water temperature in water-heating apparatus, for example, in domestic water heaters for heating washing water. The device according to the invention is, however, intended for use in other fields, although the field indicated represents a preferred choice.

The valve unit 1 has an element 1*a* which is sensitive to temperature variation and which is operatively connected to a closure member, not shown, that can be operated so as to open/close a respective valve seat (also not shown) provided inside the unit. The knob adjustment device 2 is mounted so as to be rotatable about a rotation axis X in a box-like housing 3 of the valve unit 1 and incorporates all of the adjustment functions provided for in operation, that is, enabling the pilot light to be lit (by means of a push-button 4), completely shutting off the gas-flow (OFF point of the knob), as well as adjusting the temperature of the water being heated. The adjustment in order to set gradually increasing water temperatures takes place by rotation of the knob 2 in an anticlockwise direction about the axis X as seen in FIG. 4 (the direction indicated by the arrow A).

According to a principal characteristic of the invention, the knob device 2 comprises safety means, generally indicated 4, which can restrain the knob 2 in the preselected adjustment position to prevent accidental rotation thereof such as to lead to dangerous increases in the temperature of the water being heated, as will be described in detail in the following description.

In greater detail, the restraining means 4 comprise a set of teeth 5 on the knob 2 and a tooth-shaped retaining element 6 which is fixed firmly to the housing 3 and can engage the set of teeth 5. The set of teeth is a set of face teeth and comprises a plurality of teeth 5*a* extending along an angular sector of a projection 7 protruding from the body of the knob 2. The teeth 5*a* have substantially sawtooth-like profiles each having a face 5*b* and an inclined ramp-like side 5*c* which are connected to one another and are of a shape such that, when the retaining tooth 6 is engaged with the set of teeth 5, it is in abutment with the face 5*b* of the corresponding tooth in order to prevent rotation of the knob 2 in the direction of rotation A, restraining it in the position previously set.

The retaining tooth 6 is also urged into engagement with the set of teeth 5 by resilient means including a resiliently deformable plate 8 which, for example, is made of harmonic steel and is restrained at one of its ends by the housing 3 of the valve unit and carries the retaining tooth 6 at its opposite end. The tooth 6 is advantageously formed integrally with the plate by shaping of the corresponding end thereof.

By virtue of the inclined ramp-like shape of the sides of the teeth 5, the retaining tooth 6 is free to pass over the teeth 5*a,* jumping along their sides, against the resilient force of the plate, to allow the knob to rotate freely in the opposite direction to that of the arrow A, that is, in the direction corresponding to the setting of decreasing temperature values. To facilitate the sliding movement over the sides of the teeth 5, the retaining tooth has an inclined portion 6*a* which can interfere with the ramp-like sides of the teeth 5.

The retaining tooth 6 is also arranged to be selectively releasable from the set of teeth 5, upon an intentional operation, so as to allow the knob 2 to rotate in the direction of rotation A to enable the desired temperature to be set. For this purpose, the retaining tooth 6 is associated with a push-button-like element 9 for moving the retaining tooth 6 away from the position of engagement with the tooth 5, in opposition to the resilient force of the plate 8.

The push-button-like element 9 is advantageously formed in a covering coating of plastics material of the plate 8.

Moreover, when the knob 2 is in the OFF position, its rotation is arranged to be locked as a result of the engagement of the retaining tooth 6 in a recess 10 formed in the annular projection 7 of the knob.

In operation, starting from the OFF position of the knob 2, upon depression of the push-button 9, the tooth 6 is released from the recess 10 and the knob can be rotated freely to the position in which the pilot light can be lit, in which the tooth 6 is moved into engagement with the first tooth of the set of teeth 5 (FIG. 2). A further depression of the push-button after the pilot light has been lit releases the rotation of the knob to enable the desired angular position corresponding to the preselected water temperature value to be reached. In the preselected angular position, by virtue of the engagement of the retaining tooth 6 in the set of teeth 5, accidental rotation of the knob 2 in the direction of rotation A (anticlockwise in FIG. 4) is prevented; if this rotation were permitted, it could lead to an undesired increase of the water temperature, possibly resulting in conditions dangerous to the user. Rotation of the knob in the direction A can be permitted only as a result of an intentional depression of the push-button 9.

Moreover, rotation of the knob in the opposite direction to that of the arrow A from the preselected adjustment position is permitted, without any operation of the push-button 9, by virtue of the sliding of the retaining tooth by jumping over the sides of the teeth 5. This operation enables the knob to be rotated quickly, in conditions of danger, in the direction in which the water temperature is reduced, in order to make the water-heating apparatus safe quickly and immediately, possibly extinguishing the burner (OFF position). It will thus be noted that this action does not require any pressure on the push-button 9.

The invention thus achieves the objects proposed, affording the advantages mentioned above over known solutions.

What is claimed is:

1. A knob adjustment device for adjusting the temperature in a valve unit of a water-heating apparatus, the valve unit having a rotation axis in a stationary housing, the knob adjustment device comprising a safety restraining member unidirectionally restraining the knob adjustment device relative to the housing so as to oppose rotation of the knob adjustment device in a first direction of rotation about the axis, the knob adjustment device being free to rotate in the other, opposite, second direction of rotation, the first direction of rotation of the knob adjustment device being associated with upward temperature adjustments so that the knob adjustment device is restrained with regard to the first direction of rotation to prevent increases in the temperature due to accidental rotation of the knob adjustment device.

2. The device according to claim 1 in which the restraining member is selectively releasable to allow the knob adjustment device to rotate in the first direction of rotation.

3. The device according to claim 1 in which the restraining member includes a set of teeth on the knob adjustment device and a retaining element which is fixed firmly to the housing and can engage the set of teeth.

4. The device according to claim 3 further comprising resilient means for urging the retaining element into engagement with the set of teeth.

5. The device according to claim 4 in which the knob adjustment device has a preselected angular sector, the set of teeth is a set of face teeth extending along the preselected angular sector of the knob adjustment device, and the retaining member is movable so as to be released from the set of teeth in a direction substantially parallel to the axis of rotation, in opposition to the resilient means.

6. The device according to claim 5 in which the teeth of the set of teeth have substantially sawtooth-like profiles each having a face and an inclined ramp-like side which are connected to one another, so that the retaining element abuts the faces of the teeth in order to restrain the knob adjustment device with regard to the first direction of rotation and is free to pass over the teeth by sliding along their ramp-like sides, in opposition to the resilient means, to allow the knob adjustment device to rotate freely in the second direction of rotation.

7. A knob adjustment device for adjusting the temperature in a valve unit of a water-heating apparatus, the valve unit having a rotation axis in a stationary housing, the knob adjustment device comprising:

a safety restraining member including a set of teeth on the knob adjustment device and a retaining element which is fixed firmly to the housing and can engage the set of teeth, the restraining member unidirectionally restraining the knob adjustment device relative to the housing so as to oppose rotation of the knob adjustment device in a first direction of rotation about the axis, the knob adjustment device being free to rotate in the other, opposite, second direction of rotation; and resilient means for urging the retaining element into engagement with the set of teeth, the resilient means including a resiliently deformable plate restrained, at a first end, on the stationary housing and carrying the retaining element at the opposite, second end.

8. The device according to claim 7 in which the retaining element is formed by shaping of the second end of the plate.

9. The device according to claim 8 further comprising a push-button-like element, associated with the retaining element, for moving the retaining element away from the set of teeth, against the resilient force of the plate.

10. The device according to claim 9 in which the plate has a covering coating and the push-button-like element is formed in the covering coating of the plate.

11. A knob adjustment device for adjusting the temperature in a valve unit of a water-heating apparatus, the valve unit having a rotation axis in a stationary housing, the knob adjustment device comprising:

a safety member unidirectionally restraining the knob adjustment device relative to the housing so as to oppose rotation of the knob adjustment device in a first direction of rotation about the axis, the knob adjustment device being free to rotate in the other, opposite, second direction of rotation, the safety member being selectively releasable to allow the knob adjustment device to rotate in the first direction of rotation and including a set of teeth on the knob adjustment device and a retaining element which is fixed firmly to the housing and can engage the set of teeth; and resilient means for urging the retaining element into engagement with the set of teeth, the resilient means including a resiliently deformable plate restrained, at a first end, on the stationary housing and carrying the retaining element at the opposite, second end.

12. The device according to claim 11 in which the knob adjustment device has a preselected angular sector, the set of teeth is a set of face teeth extending along the preselected angular sector of the knob adjustment device, and the safety member is movable so as to be released from the set of teeth in a direction substantially parallel to the axis of rotation, in opposition to the resilient means.

13. The device according to claim 12 in which the teeth of the set of teeth have substantially sawtooth-like profiles each having a face and an inclined ramp-like side which are connected to one another, so that the retaining element abuts the faces of the teeth in order to restrain the knob adjustment device with regard to the first direction of rotation and is free to pass over the teeth by sliding along their ramp-like sides, in opposition to the resilient means, to allow the knob adjustment device to rotate freely in the second direction of rotation.

14. The device according to claim 11 in which the retaining element is formed by shaping of the second end of the plate.

15. The device according to claim 14 further comprising a push-button-like element, associated with the retaining element, that moves the retaining element away from the set of teeth against the resilient force of the plate.

16. The device according to claim 15 in which the plate has a covering coating and the push-button-like element is formed in the covering coating of the plate.

17. A knob adjustment device for adjusting the temperature in a valve unit of a water-heating apparatus, the valve unit having a rotation axis in a stationary housing, the knob adjustment device comprising:

a preselected angular sector;

a safety member unidirectionally restraining the knob adjustment device relative to the housing so as to oppose rotation of the knob adjustment device in a first direction of rotation about the axis, the knob adjustment device being free to rotate in the other, opposite, second direction of rotation, the safety member being selectively releasable to allow the knob adjustment device to rotate in the first direction of rotation and including a set of teeth extending along the preselected angular sector of the knob adjustment device and a retaining element which is fixed firmly to the housing and can engage the set of teeth;

a resiliently deformable plate restrained, at a first end, on the stationary housing and carrying the retaining element at the opposite, second end, the plate urging the retaining element into engagement with the set of teeth; and a push-button-like element, associated with the retaining element, for moving the retaining element away from the set of teeth, against the resilient force of the plate, wherein the safety member is movable so as to be released from the set of teeth in a direction substantially parallel to the axis of rotation, in opposition to the resiliently deformable plate.

18. The device according to claim 17 in which the teeth of the set of teeth have substantially sawtooth-like profiles each having a face and an included ramp-like side which are connected to one another, so that the retaining element abuts the faces of the teeth in order to restrain the knob adjustment device with regard to the first direction of rotation and is free to pass over the teeth by sliding along their ramp-like sides, in opposition to the resiliently deformable plate, to allow the knob adjustment device to rotate freely in the second direction of rotation.

* * * * *